United States Patent [19]

Weiss

[11] Patent Number: 4,582,344

[45] Date of Patent: Apr. 15, 1986

[54] MUSIC HOLDER FOR MUSIC BOOKS, BOUND PAGES OF MUSIC AND THE LIKE HAVING LEAVES WHICH TEND TO CLOSE

[76] Inventor: Gustava Weiss, 853 Seventh Ave., New York, N.Y. 10019

[21] Appl. No.: 637,751

[22] Filed: Aug. 6, 1984

Related U.S. Application Data

[63] Continuation-in-part of Ser. No. 473,110, Mar. 7, 1983, abandoned.

[51] Int. Cl.[4] ..... B42D 17/00; A47B 97/02; A47G 1/24

[52] U.S. Cl. ..... 281/45; 248/447; 248/456

[58] Field of Search ..... 281/42, 45; 402/64; 84/180; 248/447, 453, 456

[56] References Cited

U.S. PATENT DOCUMENTS

| | | | |
|---|---|---|---|
| 395,715 | 1/1889 | Nichols | 85/180 |
| 784,631 | 3/1905 | Richardson | 84/180 |
| 1,844,744 | 2/1932 | Critchfield | 281/45 |
| 2,583,097 | 1/1952 | Heimann | 248/456 |
| 2,595,682 | 5/1952 | Lipa | 248/453 |
| 3,833,197 | 9/1974 | Dyke | 281/45 |
| 4,295,624 | 10/1981 | Granada | 248/456 |
| 4,369,948 | 1/1983 | Krauss et al. | 248/447 |
| 4,460,146 | 7/1984 | Raggiotti | 281/45 |

*Primary Examiner*—Paul A. Bell
*Assistant Examiner*—Paul M. Heyrana
*Attorney, Agent, or Firm*—Kirschstein, Kirschstein, Ottinger & Israel

[57] ABSTRACT

A music holder adapted to be placed on a piano or music stand for use with a bound book of music or bound pages of music that tend to assume a closed position unless held open, the book or music stand on which the book or bound pages are to be placed includes a bottom ledge. The music holder includes a back, a ledge or grooved bottom shelf and a front flap, the rear edge of the bottom shelf being connected to the bottom edge of the back, the bottom shelf protruding forwardly from the back, the bottom edge of the front flap being hinged to the front edge of the bottom shelf. The holder is adapted to receive a bound book of music or bound pages of music which will rest on the bottom shelf and lean back against the back with the bound book or bound pages open at certain pages and a front flap leaning rearwardly against such open pages to hold the bound book or bound pages in that open position. The holder is used pursuant to a certain method.

4 Claims, 6 Drawing Figures

MUSIC HOLDER FOR MUSIC BOOKS, BOUND PAGES OF MUSIC AND THE LIKE HAVING LEAVES WHICH TEND TO CLOSE

CROSS REFERENCE TO RELATED APPLICATION

This application is a continuation-in-part of copending application Ser. No. 473,110, filed March 7, 1983 now abandoned for HOLDER FOR BOOKS, PAGES, SHEETS AND THE LIKE HAVING LEAVES WHICH TEND TO ASSUME A CLOSED POSITION, FALL DOWN OR OTHERWISE NOT STAY IN PLACE.

BACKGROUND OF THE INVENTION

1. Field of the Invention

This invention relates to music holders for music books, bound pages of music, and the like in which the leaves, when not held open, tend to close.

2. Description of the Prior Art

Music books are, as indeed are books in general, composed of a plurality of leaves held together at a spine by a suitable binding. Usually, a music book is composed of a large number of signatures, a technical term by which a folded sheet is known. It is customary, when making a music book, to arrange signatures in groups, for example, of eight folded sheets, which will thus constitute sixteen leaves, and then to stack the signatures so that the folded edges are registered, i.e. arranged in a common, approximately plane, configuration. Thereafter, depending upon the manner of binding, the signatures are mutually secured to one another.

In the so-called Smythe mode of binding, a line of stitching is run through a large number of signatures while the signatures are compressed together adjacent the spine.

In the Perfect method of binding, a group of signatures is clamped together adjacent the spine and the fold lines are ground down to roughen the same, after which hot-melt glue is applied to the ground edges. Sometimes wire stitching is used. Sometimes wire stitching is applied through the fold itself.

Regardless of which method is used to create the binding at the spine, the great majority of music books have a common characteristic, namely, the leaves of the book tend to assume an abutting, i.e. juxtaposed or face to face, relationship, one against another, when not manually held open. If the music book is opened and then released, the pages of the book will close. Of course, a music book can be forced to stay open as by cracking the spine, but this is harmful to the book and may shorten its life. This method of handling ordinarily is not used.

There are some books, that is to say, some methods of binding books, which are not subject to this self-closing drawback. By this, reference is had to flat-opening books of which a stenographer's notebook with a spiral wire binding type is typical. Another flat opening book is one in which the binding is a series of split interconnected rings formed of a single piece of wire. Another flat opening type of book is one usually found in cook books and similar heavy books. These employ plastic binders constituted of a thin plastic strip having outwardly extending arcuate arms that curve back upon one another and pass through openings in the leaves of the book.

However, it is not customary to make music books with flat bindings. It is far more usual to bind music books in such a manner that the pages will tend to remain closed. Such books are more attractive and more popular wih musicians. However, they present a certain difficulty in use. This is that when the books are opened flat and placed with their front and back covers against the back of a music stand, the books will not remain open when released. There are various ways in which the book can be forced to stay open, but none of them is acceptable.

For example, the two halves of the book, not necessarily equal halves, can be clamped to the back of a music stand with spring clips, but this makes turning the pages difficult and also sometimes scratches the music stand, which is unacceptable when the music stand is a permanent part of a piano and is a highly finished piece of wood.

Another way to make the music book stay open is to "break" the back. However, this appreciably shortens the life of the book and is frowned upon.

Another way is to have an assistant hold the music book open to turn the pages as required. This obviously is a rather expensive procedure and, where an entire chorus in rehearsal or orchestra is involved, is impractical and unsightly.

Thus, up to the present, there has been no practical, inexpensive item available on the market that will hold an ordinary music book open and permit the pages thereof to be turned with facility without damaging the book.

Some holders have been proposed for books and the like. Among these are the ones shown in U.S. Pat. Nos. 55,897 of June 26, 1866; 2,373,617 of Apr. 10, 1945; 2,490,356 or Dec. 6, 1949; 3,606,235 of Sept. 20, 1971; and 4,199,125 of Apr. 2, 1980. None of the foregoing permits ready turning of the pages.

SUMMARY OF THE INVENTION

1. Purposes of the Invention

It is the object of the invention to provide a music holder of the character described which enables a music book, bound pages of music, etc., placed thereon to have its pages readily and easily turned by a person simultaneously playing a musical instrument or otherwise occupied with his hands, and to do so without damaging the book or pages.

It is another object of the invention to provide a music holder of the character described which constitutes relatively few and simple parts and is simple to use.

It is another object of the invention to provice a holder of the character described which can be used with music books, and bound pages of music of a variety of sizes without any adjustment to accommodate for different sizes, being selfadaptable to accomodate to various sizes.

Other objects of the invention in part will be obvious and in part will be pointed out hereinafter.

2. Brief Description of the Invention

The present invention is achieved by providing a music holder which is made of a clear transparent plastic material, preferably a material which is highly light-transmissive, a typical such material being Lucite, i.e. a methyl methacrylate resin. The structure of the music holder is extremely simple, constituting, as it does, essentially only three generally plane components.

The first component is a flat back which is designed to lie against a rearwardly sloping backrest which may be part of a piano or of a music stand or other similar device. The second component is a bottom shelf which may be grooved or ridged, the rear edge of which is hinged to the lower edge of the back. The third component is a front flap, the lower edge of which is hinged to the front edge of the bottom shelf. The two sets of hinges that are provided, the first between the back and the bottom shelf, and the second between the bottom shelf and the front flat, are free-turning hinges; in other words, they do not restrict relative rotation of the two components that each of the hinges interconnects, so that the bottom shelf can turn freely with respect to the back, and the front flap can turn freely with respect to the bottom shelf. Of course, movements of these three components are restricted by external parameters.

Thus, the back of the music holder is restricted in its movement by abutment with the backrest of a piano, a music stand, or other similar device. Similarly, the bottom shelf of the music holder is restricted in its movement by a bottom shelf of a piano on which a music book normally would rest, or by a bottom ledge of a music stand, or by a bottom ledge of a similar device. Finally, the rearwardly swinging movement of the transparent front flap is restricted by abutment of its top edge againt the front surfaces of the open pages of a music book, or bound pages of music, which is resting on the bottom shelf of the holder.

The front flap of the music holder preferably is made heavy enough to exert enough pressure on the open pages of a music book or bound pages of music located on the music holder to stop the pages of the book or bound pages of music from closing on one another.

Additionally, means can be provided to stabilize the music holder; for instance, the back of the music holder can be provided with suction cups that can grip the backrest of a piano music holder or music stand or other similar device.

To use the music holder of the present invention for playing from a music book or bound pages of music, one places the music holder on a piano or music stand. For instance, if it is to be used in connection with a piano, one places the back of the music holder on the backrest of the portion of the piano where the music book or bound pages of music normally would be placed. At this time, the bottom shelf of the music holder will rest on the bottom shelf of the music stand of the piano, and the top edge of the front flap of the music holder will fall rearwardly. The book of music, or bound pages of music, is opened to the desired pages and placed on the bottom shelf of the music holder, after which the front flap is swung up until it rests against the front surfaces of the two leaves at which the music book or bound pages of music is opened. Because the front flap is transparent, the music can be read right through the front flap; in other words, the front flap does not obstruct the player's view of the music which is situated in back of it. Then the music book or bound pages of music and the music holder are manipulated as set forth in detail hereinafter to expose successive pages of music to view as desired.

The invention consists in the features of construction, combination of elements and arrangements of parts which will be exemplified in the device hereinafter described and of which the scope of application will be indicated in the appended claims.

BRIEF DESCRIPTION OF THE DRAWINGS

In the accompanying drawings in which is shown one of the various possible embodiments of the invention.

DETAILED DESCRIPTION OF THE PREFERRED EMBODIMENTS

Figure 3:
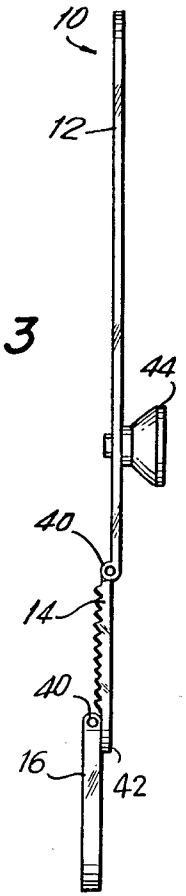
FIG. 3 is a side view of the music holder shown in FIG. 1.

Referring now in detail to the drawings, the reference numeral 10 denotes a music holder of the present invention. Said holder essentially constitutes only three components, these being a back 12, a bottom shelf 14 and a front flap 16. The front flap 16 is made of a transparent, clear, colorless material and has a flat, rectangular configuration. The material should have good light-transmissive qualities. Glass would be satisfactory, but it is somewhat too heavy for the adjunct of the character under consideration. Although the front flap is required, as soon will be seen, to be somewhat heavy, if it is made of glass, some people would consider it to be too heavy. Furthermore, if it were made of glass, it might break too easily if dropped, or if accidentally struck with a heavy object. The material of preference for the front flap is a plastic material, such a thermoplastic. The preferred material is Lucite, made by the Dupont Company, the same being a methyl methacrylate.

The rear edge 18 of the front flap desirably is straight and immediately adjacent the bottom edge 20 of the bottom shelf 14 which, likewise, preferably is straight. The front edge 22 of the front flap may be straight, as illustrated, and parallel to the rear edge 18, since this provides a neat, pleasing appearance. However, this particular configuration of the front edge 22 is not critical and, if desired, the same may be convex, concave or otherwise shaped, as the manufacturer deems expedient or desirable. In general, however, the front flap 16 is of rectangular configuration.

Figure 1:
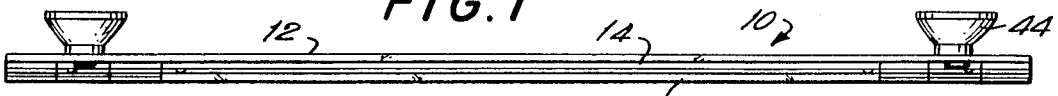
FIG. 1 is a top view of a music holder constructed in accordance with and embodying the present invention, the various components thereof being vertically aligned as if the uppermost component were held and the two lowermost components were dangling therefrom.

The bottom shelf 14 likewise is of rectangular configuration. As noted previously, its bottom edge 20 (as viewed in FIG. 1) is straight. Furthermore, its top edge 24 likewise straight and is parallel to the edge 20. The configuration of the top edge 26 of the back 12 is wholly governed by esthetics, and it will be made in a shape that the trade finds acceptable or that sells well. It has been illustrated as straight and parallel to the edge 24. The bottom edge 28 of the back is straight and parallel to the edge 20.

The back 12 and bottom shelf 14 are flat. The bottom shelf 14 also may be ridged or grooved to inhibit slippage of a music book or bound pages of music placed thereon. They may be made from any material, but desirably are made from a material which is not expensive and is not particularly heavy. For the sake of appearance, these two components of the music holder likewise may be plastic and, for uniformity, a light-transmissive, colorless plastic, such as that employed for the front flap 16, namely, Lucite. The back 12 and bottom shelf 14 are of a thinner material than that of the front flap for a reason which will be pointed out. By way of example, the back 12 and the bottom shelf 14 are made from Lucite sheet which is $\frac{1}{8}''$ in thickness, while the front flap is made from a Lucite sheet which is $\frac{1}{4}''$ in thickness. Such dimensions are given by way of example and are not to be considered as controlling or critical. The back may be lightly roughened to render the same translucent and thus improve its appearance.

The edges 18, 20, 24 and 28 are perpendicular to the height of the music holder in order to facilitate appearance and articulation thereof.

The music holder includes a suitable first means for articulatably joining the back 12 to the bottom shelf 14, and a suitable second means for articulatably joining the bottom shelf 14 to the front flap 16. Said first means constitutes a pair of laterally spaced hinges 30, 32, one at each side of the music holder, for hingedly connecting the back to the bottom shelf. Each such hinge includes a pair of laterally spaced knuckles 34, 36 unitary with and extending from the bottom edge 28 of the back 12 to receive between them a third knuckle 38 unitary with and extending from the top edge of the bottom shelf 14. The three knuckles 34, 36 and 38 of each hinge 30, 32 are formed with registered bores to receive plastic pintles 40 that are fixed in the endmost knuckles 34, 36, leaving the pintles free to turn with respect to the center knuckle 38.

Figure 2:
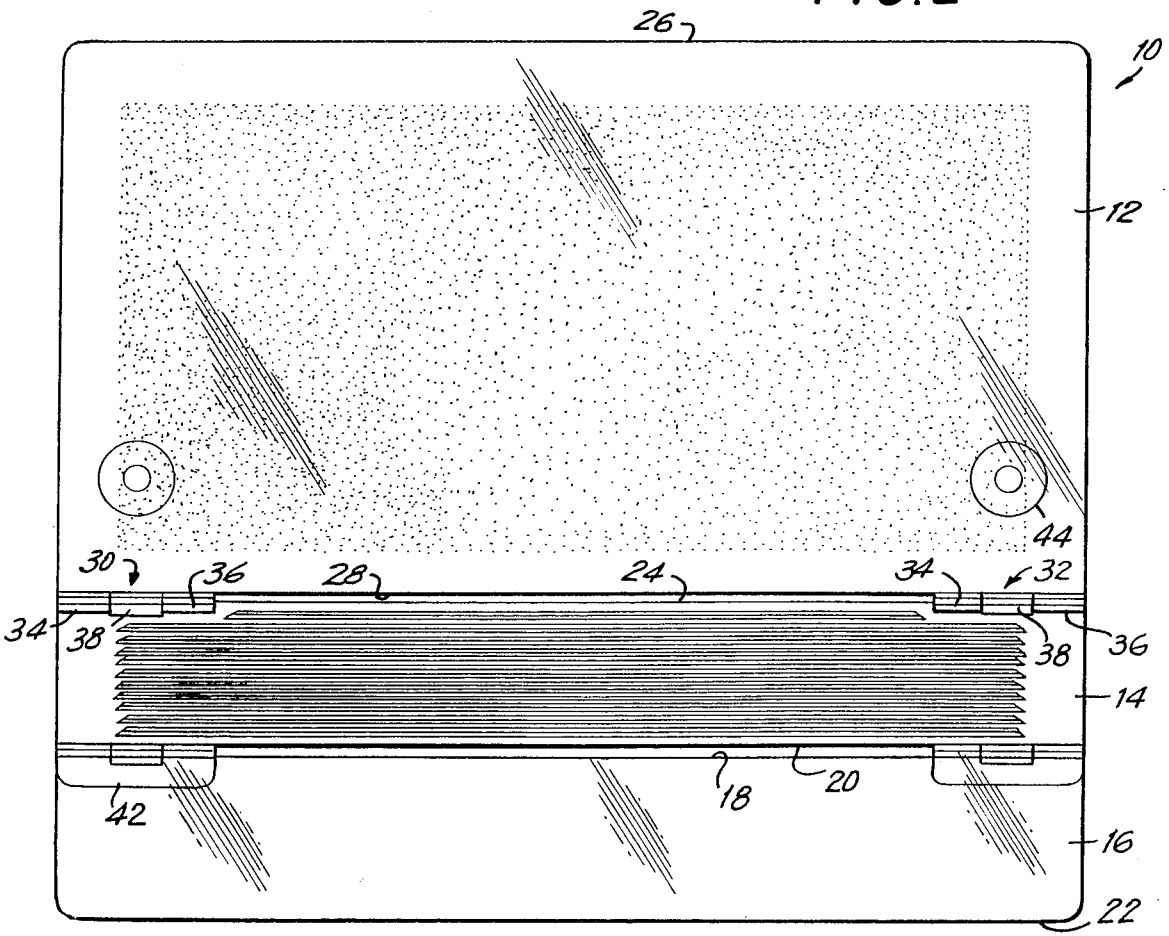
FIG. 2 is a front view of the music holder shown in FIG. 1.
Figure 6:
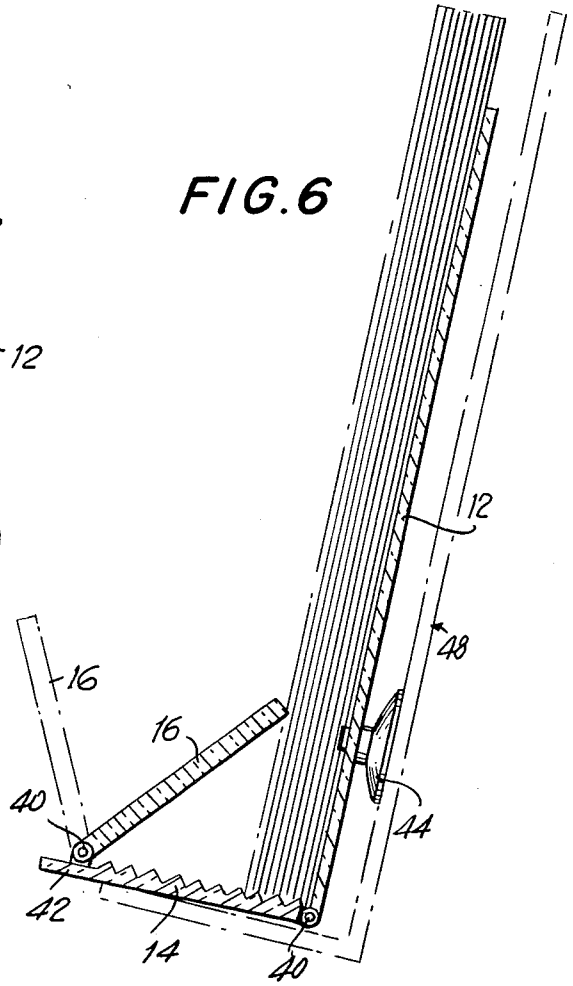
FIG. 6 is an enlarged sectional view taken substantially along the line 6—6 of FIG. 5.

The second set of articulatable hinging means is essentially identical to the first, except that its knuckles 34', 36' further include downward extensions 42 of the bottom shelf 14 to limit counterclockwise rotation of the front flap 16 away from its idle hanging position shown in FIG. 2 by abutment with the back surface of the bottom shelf 14.

In use, as soon will be pointed out, the front flap 16 falls back under gravity against the open pages of the music book, or bound pages of music, which then are in front, being placed in that position manually as by a instrumentalist or other user. The front flap is heavy enough to hold these pages down against the page-closing bias of the pages in back of it, and for this purpose, a front flap of $\frac{1}{4}''$ Lucite has sufficient weight. Thicker front flaps of similar material also will serve the purpose. It is not necessary to use sheets of Lucite of that thickness for the remaining parts of the holder have been made of $\frac{1}{8}''$ Lucite and the front flap of $\frac{1}{4}''$ Lucite.

When a page is to be turned the following procedure will be observed:

(1) the fingers of the right hand (exclusive of the thumb and preferably including at least the index finger and optionally the middle finger) are inserted beneath the page (or pages) to be turned, usually near the top outer corner of the page (or pages), while the thumb of the right hand is placed below the flap and the ball of the thumb allowed to rest lightly on the then front surface of the flap—or vice versa.

(2) Now the right hand is moved from right to left as a result of which various events occur:

(a) The movement of the fingers (exclusive of the thumb) toward the left bends the page (or pages) to be turned about an axis approximately parallel to the right hand edge (the bending may move this right hand edge away from the remaining pages beneath it, i.e. forwardly, or it may move the fold line forwardly—usually it will be the right hand edge that moves forwardly). The bending of the page moves the right hand (free) edge of the page toward the left, toward and across the binding, and, eventually all the way to the left of the book in its fully page-turned position.

(b) As the folded page moves from right to left, the folded or bent page (or pages) becomes effectively thicker in a dimension perpendicular to the plane of the opened book thereby pivoting the front flap forwardly. Such motion is aided by the movement of the fingers from right to left. However, such motion is restrained by the thumb which prevents the flap from falling.

(c) The thumb is kept under (in front of) the flap as the page (or pages) is turned.

(3) Upon completion of movement of the right hand the pages (or pages) has been turned and the flap is folded, the pages in turned position ready to be read. Completion of the hand's movement has left the flap free to rest on the turned pages.

Suitable means may be provided to mount the music holder on a conventional support such, for instance, as a music stand or a music holder such as a metal music stand or a wooden music stand or a piano music stand or any other similar device. Thus, many grand pianos and upright pianos have music stands which inlude a rearwardly sloping backrest and a rearwardly tilted bottom shelf. One or more clamps may be provided, either loose or attached at suitable locations to the music holder which clamps are designed to engage the rearwardly sloping backrest of the piano music stand, other music stand, or similar device; or the music holder may be provided at its back with a pair of suction cups designed to engage by suction the smooth front surface of a backrest of a music stand or the like. To this end, there are shown in the accompanying figures a pair of suction cups 44 suitably secured to the rear surface of the back 12 of the music holder, e.g. by cementing.

Figure 5:
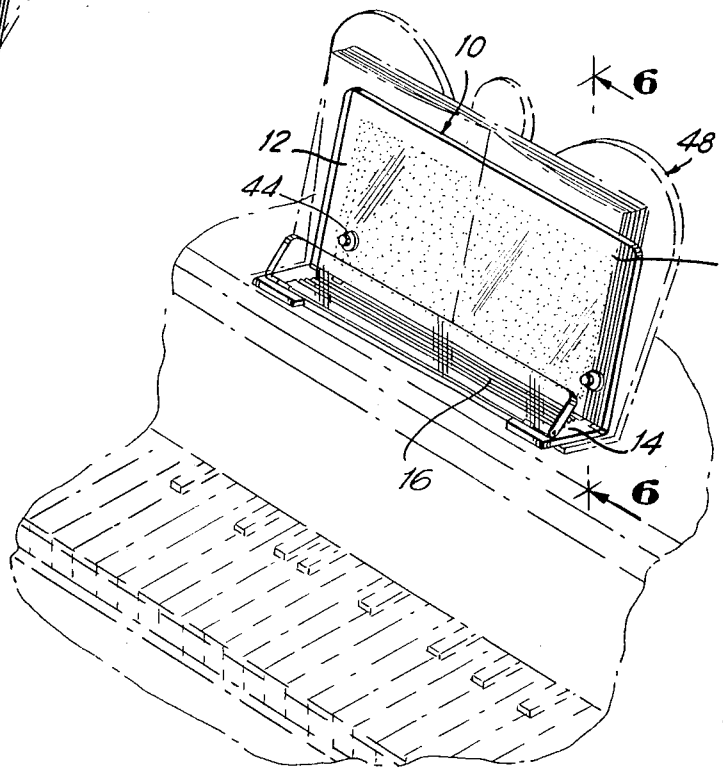
FIG. 5 is a perspective view, similar to FIG. 4, but showing the music holder as it appears when placed on a backrest of a piano, the latter being shown in phantom.
Figure 4:
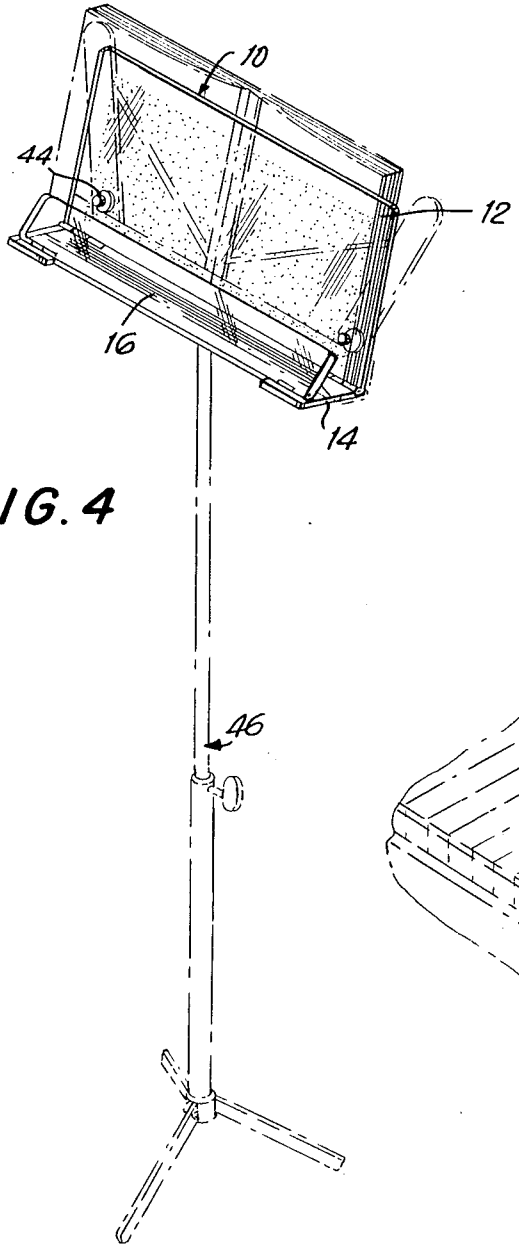
FIG. 4 is a perspective view illustrating said music holder as it appears in use when mounted on a music stand, the latter being shown in phantom.

In FIGS. 4 and 5, a music holder 10 is shown mounted in place, on a music stand 46 in FIG. 4, and on a piano music stand 48 in FIG. 5. In both instances, the suction cups are employed to hold the music holder to the stand. The music stand 46 illustrated in FIG. 4 is entirely conventional and includes the usual side adjustable flat metal arms 50 to which the suction cups 44 are adhered.

Referring to FIG. 5, the music stand there shown is an integral part of the piano illustrated in that figure and constitutes a backrest which is foldable into a horizontal position when the piano is closed, and is erected into a slanted back position as illustrated when the piano is open and in which position it will accept a music book or bound pages of music. It is illustrated in FIG. 5 as accepting the music holder 10 with the suction cups 44 adhered to the music stand 48.

The music holder is positioned so that the back 12 thereof is adjacent the backrest of the music stand, and the bottom shelf 14 is adjacent the bottom of the music stand, said bottom shelf extending approximately perpendicularly outwardly from the back 12.

The front flap 16 is inclined upwardly and rearwardly as illustrated in FIGS. 4 and 5. It will be observed that the front flap, from the rear edge of the bottom shelf to the hinges joining the front flap to the front edge of the bottom shelf, is longer than the distance from said hinges to the back, so that as the front flap leans rearwardly, it cannot come into contact with the bottom shelf 14 but, rather, first will touch some part of the music book, or pages of bound music. If, as is normally the case, the music book is open to a selected set of pages, the front edge 22 of the front flap 16 will touch the forward facing pages of the open book and will hold the book open in that position and in place. To this end, the front flap is made about ½" wider than the bottom shelf of the music holder.

Since the front flap is completely transparent, it is easy to read whatever music, lyrics, text, etc. is present on said open pages. Hence, the user of said music holder has no difficulty in reading or seeing the score, text, or other matter.

It thus will be seen that there is provided a device which achieves the various objectives of the invention and which is well adapted to meet the conditions of practical use.

As various possible embodiments might be made of the above invention, and as various changes might be made in the embodiment above set forth, it is to be understood that all matter herein described or shown in the acompanying drawings is to be interpreted as illustrative and not in a limiting sense.

Having thus described the invention, there is claimed as new and desired to be secured by Letters Patent:

1. A music holder adapted to be placed on the bottom ledge of a piano or music stand for use with a bound book of music or bound pages of music, said music holder principally consisting of:

(a) a back having a bottom edge, (b) a bottom shelf having a rear edge and a front edge, (c) means articulatably connecting the rear edge of said bottom shelf of the holder to the bottom edge of said back so that said front edge of said bottom shelf protrudes forwardly relative to said back to provide a support on which to rest a music book or bound pages of music, (d) said bottom shelf of said holder being adapted to be placed on the bottom ledge of the piano or music stand, wherein the improvement comprises:

(e) a single clear transparent front flap of plastic material extending from side-to-side of the bottom shelf, said flap having a bottom edge and a top edge, (f) means articulatably connecting the bottom edge of the transparent front flap adjacent the bottom shelf of the music holder to the front edge of said holder, (g) the front-to-back width of said transparent front flap normal to the side-to-side length of said transparent front flap exceeding the front-to-back width of said bottom shelf of the music holder normal to the side-to-side length of said music holder so that when an open music book or bound sheets of music is placed on the music holder with the bottom shelf of the music holder resting on the bottom ledge of the piano or music stand, the top edge of the transparent front flap will fall back on the open forwardly facing pages of the music book or bound sheets of music, (h) said transparent front flap of said music holder being sufficiently heavy to hold the pages of the music book or bound pages of music open and in place, and (i) the bottom edge of the transparent front flap and the front edge of the bottom shelf of the music holder being straight and parallel to one another.

2. A music holder as set forth in claim 1 wherein the transparent front flap is ½" wider than the bottom shelf of the holder.

3. A music holder as set forth in claim 1 wherein means is provided to limit rotation of the transparent front flap relative to the bottom shelf of the music holder in a direction away from said shelf.

4. A music holder as set forth in claim 1 wherein means is provided to limit counterclockwise rotation of the transparent front flap relative to the bottom shelf of the music holder beyond 180° away from the shelf.

* * * * *